US007293603B2

(12) United States Patent
Cox

(10) Patent No.: US 7,293,603 B2
(45) Date of Patent: Nov. 13, 2007

(54) PLASTIC OIL COOLER

(76) Inventor: Richard D. Cox, 40824 Coventry, Novi, MI (US) 48375

( * ) Notice: Subject to any disclaimer, the term of this patent is extended or adjusted under 35 U.S.C. 154(b) by 498 days.

(21) Appl. No.: 10/982,862

(22) Filed: Nov. 6, 2004

(65) Prior Publication Data

US 2006/0096745 A1 May 11, 2006

(51) Int. Cl.
*F28D 7/12* (2006.01)
*F28D 7/10* (2006.01)

(52) U.S. Cl. ..... 165/156; 165/157; 165/916

(58) Field of Classification Search ..... 165/156, 165/157, 916
See application file for complete search history.

(56) References Cited

U.S. PATENT DOCUMENTS

| | | | |
|---|---|---|---|
| 1,005,441 | A | 10/1911 | Lovekin |
| 1,148,865 | A | 8/1915 | Shipman |
| 1,279,008 | A | 9/1918 | Ross |
| 1,293,413 | A | 2/1919 | Gray |
| 1,818,343 | A | 8/1931 | Monroe |
| 2,016,746 | A | 10/1935 | Ireland |
| 2,060,936 | A | 11/1936 | Haag |
| 2,341,319 | A | 2/1944 | Graham |
| 2,445,115 | A | 7/1948 | Hanrahan |
| 2,900,168 | A | 8/1959 | Nyborg |
| 3,270,806 | A | 9/1966 | Borrini |
| 3,468,371 | A | 9/1969 | Menze |
| 3,566,615 | A | 3/1971 | Roeder |
| 3,831,672 | A | 8/1974 | Battisti |
| 3,850,230 | A | 11/1974 | Margen |

(Continued)

FOREIGN PATENT DOCUMENTS

| | | |
|---|---|---|
| DE | 31764 | 1/1885 |

(Continued)

*Primary Examiner*—Cheryl Tyler
*Assistant Examiner*—B. Clayton McCraw
(74) *Attorney, Agent, or Firm*—Andrew W. Ludy

(57) ABSTRACT

A heat exchanger transfers heat between primary and secondary fluid coolants. A housing has a longitudinal central axis lying within a transverse housing plane. A bottom wall with a concave inner surface faces upward and extends along the central axis. A plurality of arcuately helical lower sector fins are spaced apart along the central axis on the bottom wall inner surface. A cover has a longitudinal central axis lying within a transverse cover plane. A top wall with a concave inner surface faces downward and extends along the central axis. A plurality of arcuately helical upper sector fins are spaced apart along the central axis on the top wall inner surface.

A copper tube is assembled into the housing in a direction transverse to the housing axis with the tube closely adjacent the lower sector fins. First and second sealing means seal the tube ends to the housing. The cover is assembled into the housing in a direction transverse to the housing axis with the upper sector fins closely adjacent the tube. The upper sector fins, the top wall, the lower sector fins, the bottom wall, and the tube outer surface define a helical passageway around the tube outer surface. Primary coolant nozzles will direct the primary coolant through the tube. Secondary coolant nozzles and secondary coolant conduits will direct the secondary coolant through the helical passageway.

The housing, the primary nozzles, the secondary nozzles, and the secondary conduits, are molded as a single unitary piece from a polymeric material consisting of either thermoplastic or thermoset resins. The cover is also molded as a single, unitary piece from a polymeric material.

23 Claims, 7 Drawing Sheets

U.S. PATENT DOCUMENTS

| | | | |
|---|---|---|---|
| 3,990,424 | A | 11/1976 | Miersch et al. |
| 4,086,959 | A | 5/1978 | Habdas |
| 4,218,999 | A | 8/1980 | Shearer |
| 4,220,121 | A | 9/1980 | Maggiorana |
| 4,924,838 | A | 5/1990 | McCandless |
| 5,251,603 | A | 10/1993 | Watanabe et al. |
| 5,487,423 | A | 1/1996 | Romero |
| 5,799,726 | A | 9/1998 | Frank |
| 6,220,344 | B1 | 4/2001 | Beykirch et al. |
| 6,293,335 | B1 | 9/2001 | Tawney et al. |
| 6,568,467 | B1 | 5/2003 | Ohira et al. |
| 6,736,198 | B2 | 5/2004 | Zhu et al. |
| 2003/0121648 | A1 | 7/2003 | Hong et al. |
| 2004/0007350 | A1 | 1/2004 | Wu |

FOREIGN PATENT DOCUMENTS

| | | |
|---|---|---|
| DE | 804502 | 4/1951 |
| DE | 33 20 956 | 12/1984 |
| GB | 605241 | 7/1948 |
| GB | 822705 | 10/1959 |
| GB | 980412 | 1/1965 |
| GB | 1089488 | 11/1967 |
| GB | 2204945 | 11/1988 |
| GB | 326278 | 12/2003 |
| WO | WO81/03539 | 12/1981 |
| WO | WO 02/061359 | 8/2002 |
| WO | WO 03/040641 A1 | 5/2003 |

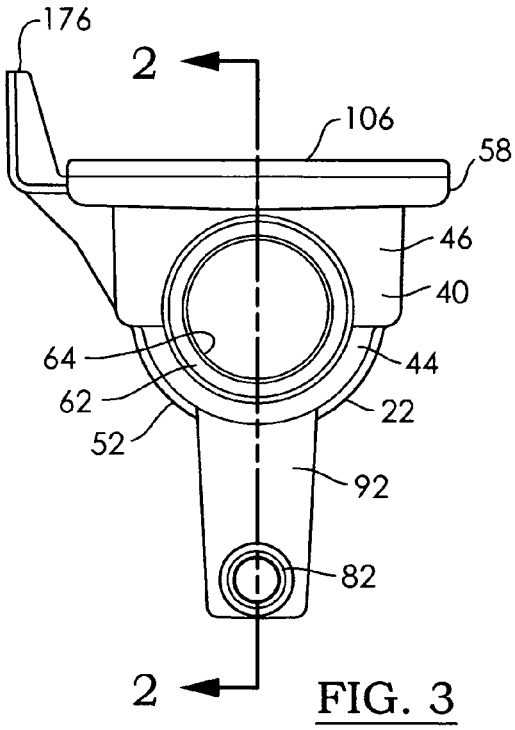
FIG. 3
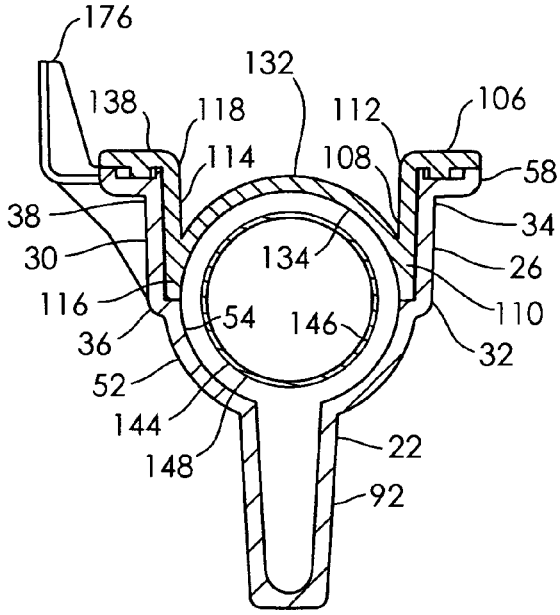
FIG. 4
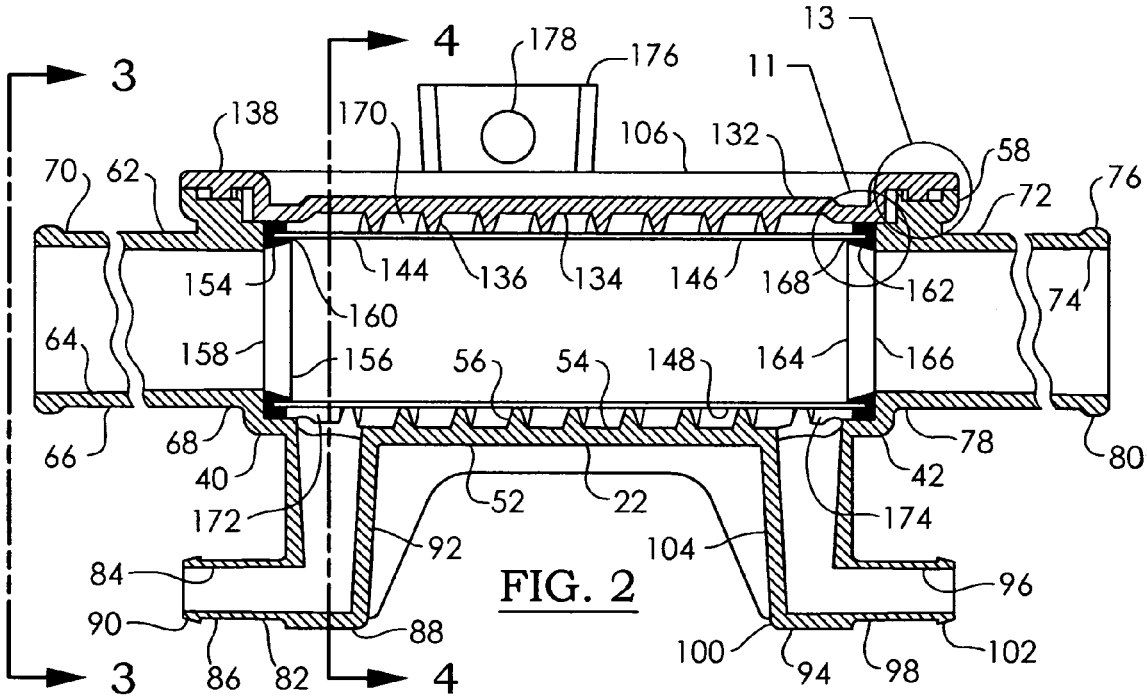

PLASTIC OIL COOLER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of heat exchangers, and more particularly to a molded plastic tube-in-tube heat exchanger, especially for vehicle engine oil cooling.

Tube-in-tube type heat exchangers are commonly used with vehicle and stationary engines for oil cooling, and are also found on auxiliary generators and in industrial and chemical process plants. Tube-in-tube type heat exchangers are well known, and have taken a variety of configurations in the past. Some examples of heat exchangers in the prior art are shown in the following patents:

Graham, U.S. Pat. No. 2,341,319, Habdas, U.S. Pat. No. 4,086,959, and Shearer, U.S. Pat. No. 4,218,999, each discloses two coaxial tubes with a helical fin turbulator enclosed within the annular space between the tubes.

McCandless, U.S. Pat. No. 4,924,838, and Roeder, U.S. Pat. No. 3,566,615, each depict two coaxial tubes, one or both of which are formed into a helical turbulator enclosed within the annular space between the tubes.

In the above-described inventions, there is no elastomer seal between the inner and outer tubes. The housing is not plastic, and hence is subject to corrosion. The parts must be assembled axially, then sealed by expanding or welding. The process is labor intensive, and the product is subject to leakage. The inlets and outlets are not molded integral with the housing, but are welded on. The turbulator is not molded integral with the housing, but is formed of metal, then threaded into grooves or welded on. None of the prior-art devices has a mounting bracket molded integral with the housing. All of the above-described devices are assembled axially in a complicated process that is difficult to seal.

Accordingly, there is a need to provide a tube-in-tube type heat exchanger that has a plastic housing to preclude corrosion.

There is a further need to provide a heat exchanger of the type described and wherein the housing is split lengthwise for fast and easy assembly.

There is a yet further need to provide a heat exchanger of the type described and that has an elastomer seal between the inner and outer tubes, for easy assembly and positive sealing.

There is a still further need to provide a heat exchanger of the type described and wherein all of the inlets and outlets are molded integral with the housing.

There is another need to provide a heat exchanger of the type described and wherein the turbulator is molded integral with the housing.

There is yet another need to provide a heat exchanger of the type described and that transfers heat through a metal for efficient heat flow.

There is still another need to provide a heat exchanger of the type described and that has a mounting bracket molded integral with the housing.

There is an additional need to provide a heat exchanger of the type described and that can be manufactured cost-effectively in large quantities of high quality.

BRIEF SUMMARY OF THE INVENTION

In accordance with the present invention, there is provided a heat exchanger for transferring heat between a primary fluid coolant and a secondary fluid coolant. These coolants are supplied by a primary fluid coolant system and a secondary fluid coolant system respectively. The heat exchanger comprises a housing having opposite housing front and housing rear aspects extending between opposite housing first and housing second ends. The housing has a transverse housing plane with upper and lower surfaces, and a longitudinal central axis lying within the housing plane. The housing has a bottom wall with a concave inner surface facing upward and extending along the central axis between the housing first and housing second ends. The bottom wall extends in a circular arc around the central axis. The housing has a plurality of lower sector fins spaced apart along the central axis on the bottom wall inner surface. The lower sector fins each extend in a helical arc around the central axis. The bottom wall and the lower sector fins extend arcuately from the housing plane lower surface adjacent the housing front aspect to the housing plane lower surface adjacent the housing rear aspect.

A cover is provided, having opposite cover front and cover rear aspects extending between opposite cover first and cover second ends. The cover has a transverse cover plane with upper and lower surfaces, and a longitudinal central axis lying within the cover plane. The cover has a top wall with a concave inner surface facing downward and extending along the central axis between the cover first and cover second ends. The top wall extends in a circular arc around the central axis. The cover has a plurality of upper sector fins spaced apart along the central axis on the top wall inner surface. The upper sector fins each extend in a helical arc around the central axis. The top wall and the upper sector fins extend arcuately from the cover plane upper surface adjacent the cover front aspect to the cover plane upper surface adjacent the cover rear aspect. The cover is adapted for assembly into the housing in a direction transverse to the housing central axis.

A circular cylindrical tube is provided, having a central axis. The tube has inner and outer surfaces extending along the central axis between opposite first and second ends. The tube is adapted for assembly into the housing in a direction transverse to the housing central axis. First and second sealing means are provided for sealing the tube first end and second end respectively to the housing. The tube and the first and second sealing means are received in the housing with the tube closely adjacent the lower sector fins, and with the tube central axis being substantially collinear with the housing central axis.

The cover is received in the housing with the cover plane closely adjacent the housing plane. The cover first and cover second ends are adjacent the housing first and housing second ends respectively. The upper sector fins are closely adjacent the tube. The upper sector fins are substantially aligned with the lower sector fins. The cover central axis is substantially collinear with the housing central axis.

The upper sector fins, the top wall, the lower sector fins, the bottom wall, and the tube outer surface define a helical passageway around the tube outer surface. This extends from a helical passageway first end adjacent the housing first end to a helical passageway second end adjacent the housing second end.

First and second primary connecting means are provided for connecting the primary fluid coolant system to the housing adjacent the housing first and second ends, respectively. This allows a flow of primary fluid coolant between the primary fluid coolant system and the tube.

First and second secondary connecting means are provided for connecting the secondary fluid coolant system to the helical passageway first and second ends, respectively. This allows a flow of secondary fluid coolant between the secondary fluid coolant system and the helical passageway.

In this manner, the tube, the first and second sealing means, and the cover, will be quickly and easily assembled into the housing.

BRIEF DESCRIPTION OF THE SEVERAL VIEWS OF THE DRAWING

A more complete understanding of the present invention may be obtained from consideration of the following description in conjunction with the drawing, in which:

FIG. 2 is a front, sectional elevational view of the heat exchanger of FIG. 1, taken along lines 2-2 of FIG. 3;

FIG. 3 is a left side elevational view of the heat exchanger of FIG. 1, taken along lines 3-3 of FIG. 2;

FIG. 4 is a left side sectional elevational view of the heat exchanger of FIG. 1, taken along lines 4-4 of FIG. 2;

DETAILED DESCRIPTION OF THE INVENTION

Figure 1:
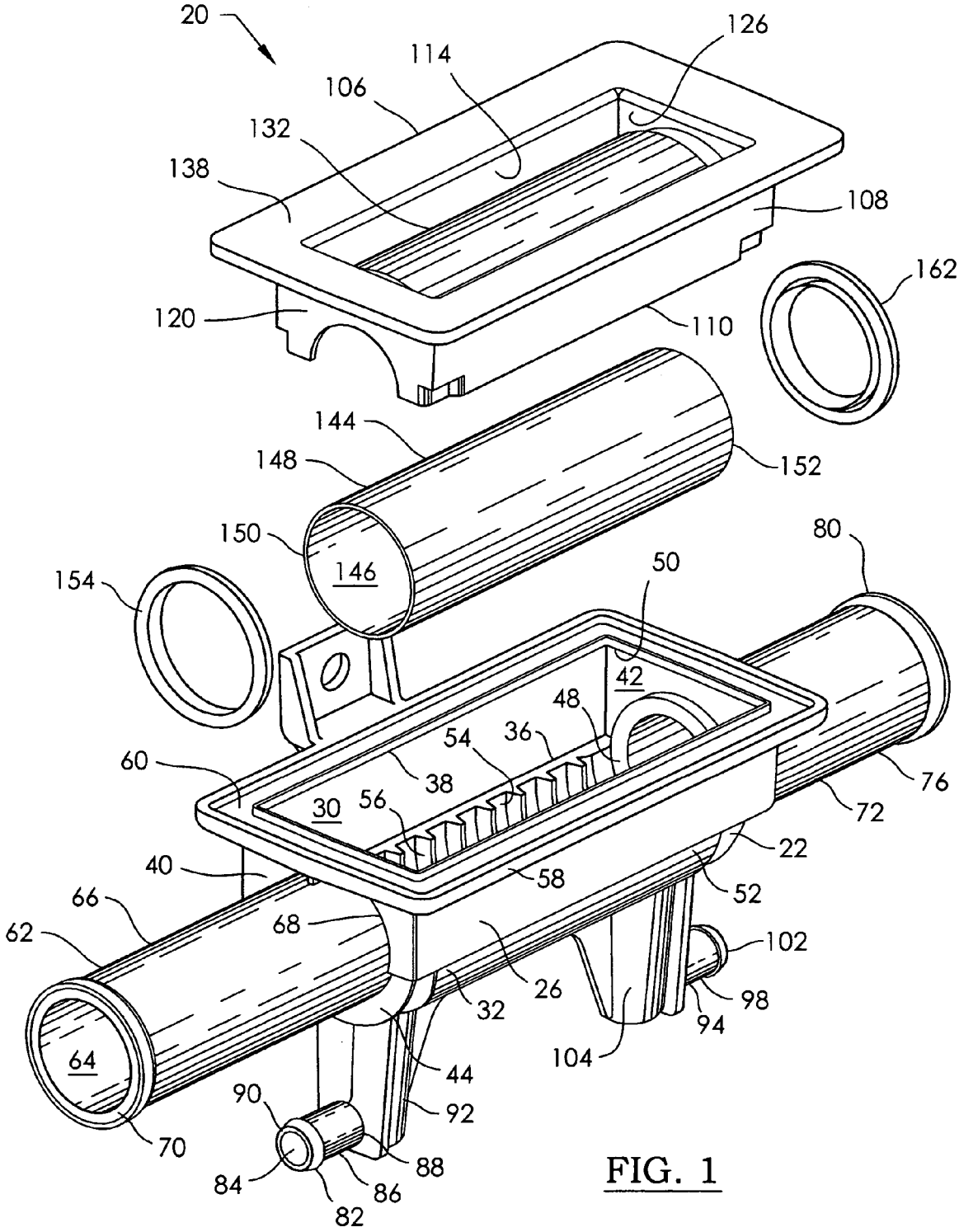
FIG. 1 is an exploded assembly view of a heat exchanger constructed in accordance with the invention.
Figure 5:
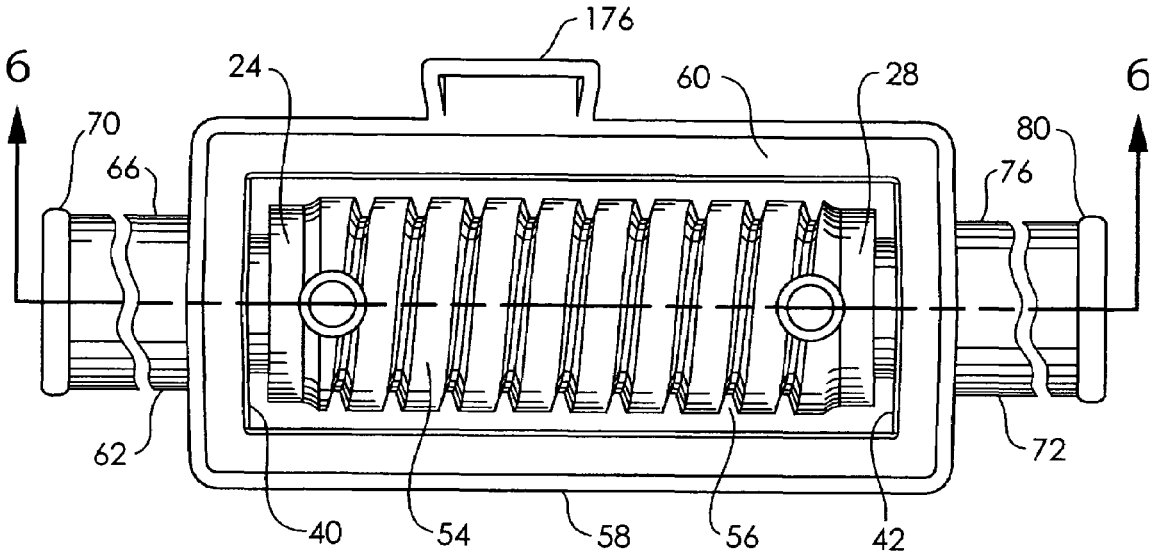
FIG. 5 is a top plan view of the housing of the heat exchanger of FIG. 1.
Figure 6:
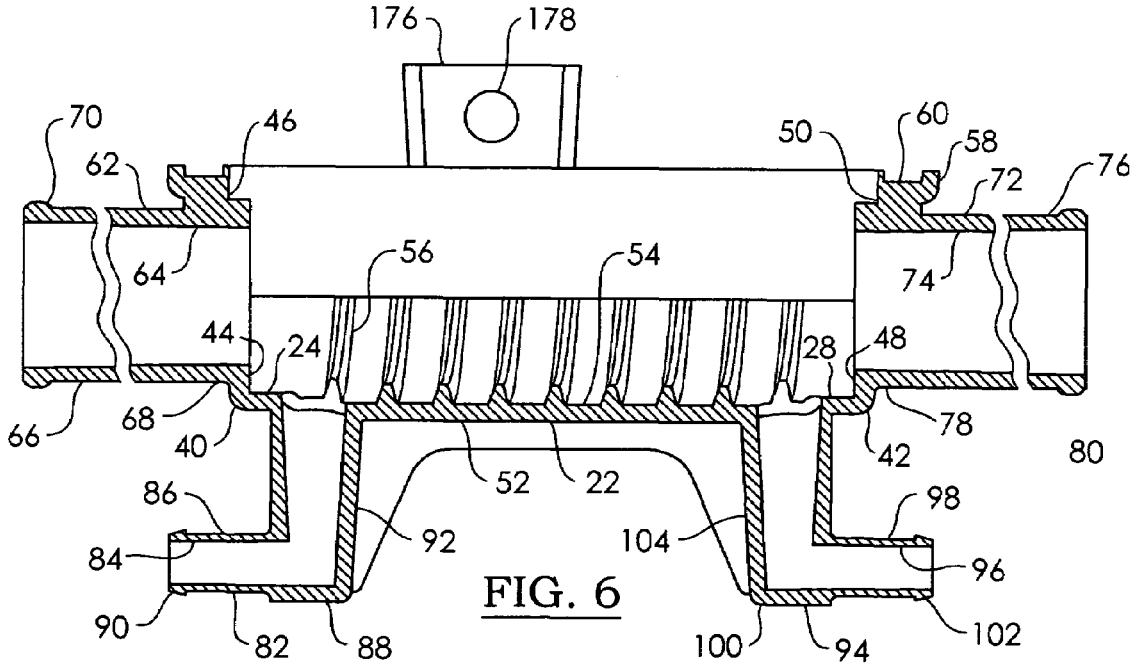
FIG. 6 is a front, sectional elevational view of the housing of FIG. 5, taken along lines 6-6 of FIG. 5.
Figure 8:
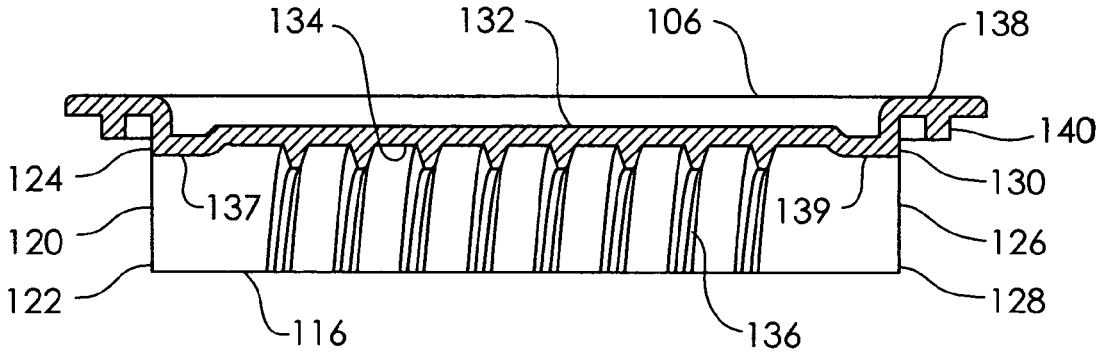
FIG. 8 is a front, sectional elevational view of the cover of FIG. 7, taken along lines 8-8 of FIG. 7.
Figure 7:
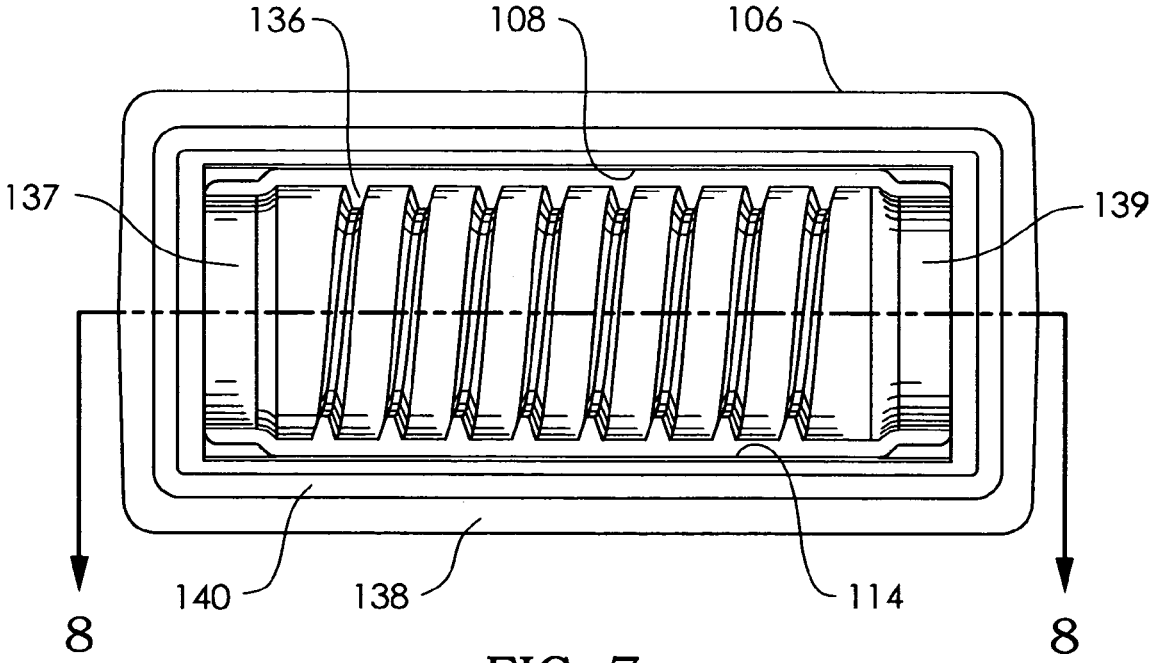
FIG. 7 is a bottom view of the cover of the heat exchanger of FIG. 1.
Figure 9:
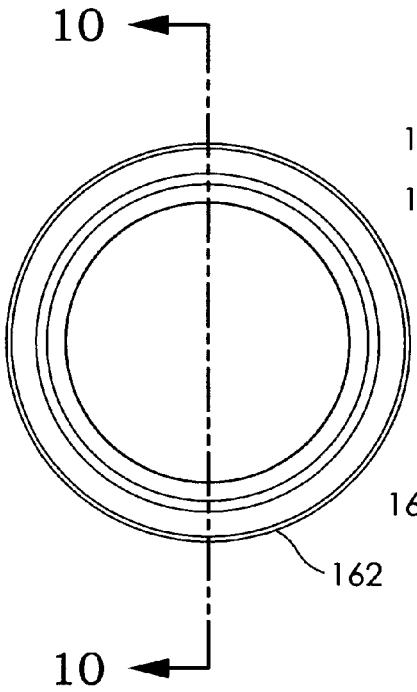
FIG. 9 is an inner side elevational view of the seal of the heat exchanger of FIG. 1.
Figure 10:
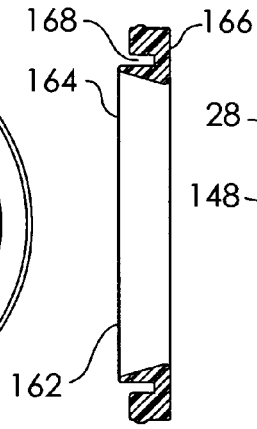
FIG. 10 is a front sectional elevational view of the seal of FIG. 9, taken along lines 10-10 of FIG. 9.
Figure 11:
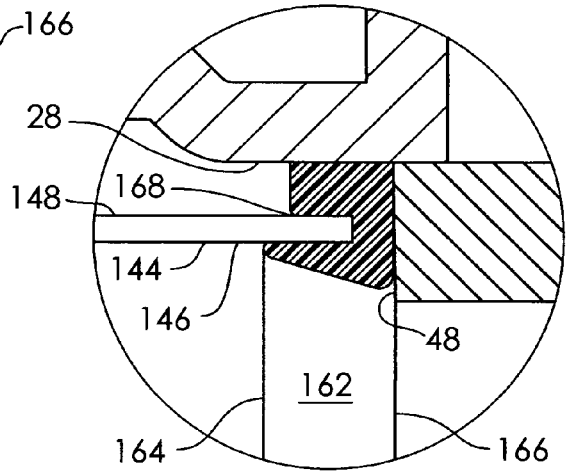
FIG. 11 is an enlarged, detail view of the seal of FIG. 9, taken at detail 11 of FIG. 2.

Referring now to the drawing, and especially to FIGS. 1 through 6 thereof, a heat exchanger is shown at 20, and is for transferring heat between a primary fluid coolant and a secondary fluid coolant, supplied by a primary fluid coolant system and a secondary fluid coolant system respectively (not shown). The heat exchanger 20 comprises a housing 22, having a housing front wall 26, and an opposite housing rear wall 30. The housing front 26 and housing rear 30 walls are spaced apart and generally parallel. The housing front wall 26 extends between lower 32 and upper 34 edges. The housing rear wall 30 extends between lower 36 and upper 38 edges. The housing front 26 and housing rear 30 walls extend between opposite housing first 40 and housing second 42 end walls. The housing first end wall 40 extends between lower 44 and upper 46 edges. The housing second end wall 42 extends between lower 48 and upper 50 edges. The housing 22 has a transverse housing plane (not shown) with upper and lower surfaces. The housing 22 has a longitudinal central axis (not shown) lying within the housing plane. The housing 22 has a bottom wall 52 with a concave inner surface 54 facing upward and extending along the central axis between the housing first 40 and housing second 42 end walls. The bottom wall 52 extends in a circular arc around the central axis. The housing 22 has a plurality of lower sector fins 56 spaced apart along the central axis on the bottom wall inner surface 54. The lower sector fins 56 each extend in a helical arc around the central axis. The bottom wall 52 and the lower sector fins 56 extend arcuately from the housing plane lower surface adjacent the housing front wall lower edge 32 to the housing plane lower surface adjacent the housing rear wall lower edge 36. The housing 22 has a housing flange 58 extending around the housing front and housing rear wall upper edges 34 and 38 respectively, and around the housing first and housing second end wall upper edges 46 and 50 respectively. The housing flange 58 projects outward from the housing 22. The housing flange 58 has an upward facing groove 60 extending around the housing flange 58. The housing 22 has a housing first seal seat 24 on the bottom wall inner surface 54 adjacent the housing first end wall 40, and a housing second seal seat 28 on the bottom wall inner surface 54 adjacent the housing second end wall 42. The seal seats 24 and 28 will be described more completely later on.

A first primary connecting means is provided, which includes a first primary coolant nozzle 62. Specifically, the first primary coolant nozzle 62 is a circular cylinder having a central axis, with inner 64 and outer 66 surfaces extending along the central axis between opposite proximal 68 and distal 70 ends. The proximal end 68 is attached to the housing first end wall 40. The first primary coolant nozzle central axis is substantially collinear with the housing central axis.

A second primary connecting means is provided, which includes a second primary coolant nozzle 72. Specifically, the second primary coolant nozzle 72 is a circular cylinder having a central axis, with inner 74 and outer 76 surfaces extending along the central axis between opposite proximal 78 and distal 80 ends. The proximal end 78 is attached to the housing second end wall 42. The second primary coolant nozzle central axis is substantially collinear with the housing central axis.

A first secondary connecting means is provided, which includes a first secondary coolant nozzle 82. Specifically, the first secondary coolant nozzle 82 is a circular cylinder and having a central axis, with inner 84 and outer 86 surfaces extending along the central axis between opposite proximal 88 and distal 90 ends. The first secondary connecting means also includes a first secondary coolant conduit 92, which is hollow and extends between the first secondary coolant nozzle proximal end 88 and the housing 22 adjacent the housing first end wall 40.

A second secondary connecting means is provided, which includes a second secondary coolant nozzle 94. Specifically, the second secondary coolant nozzle 94 is a circular cylinder having a central axis, with inner 96 and outer 98 surfaces extending along the central axis between opposite proximal 100 and distal 102 ends. The second secondary connecting means also includes a second secondary coolant conduit 104, which is hollow and extends between the second secondary coolant nozzle proximal end 100 and the housing 22 adjacent the housing second end wall 42.

The housing 22, the first primary coolant nozzle 62, the second primary coolant nozzle 72, the first secondary coolant nozzle 82, the second secondary coolant nozzle 94, the first secondary coolant conduit 92, and the second secondary coolant conduit 104, are molded as a single, unitary piece from a polymeric material selected from the group consisting of thermoplastic resins and thermoset resins.

Turning now to FIGS. 7 through 13, as well as FIGS. 1 through 6, the heat exchanger 20 further comprises a cover 106 having a cover front wall 108, and an opposite cover rear wall 114. The cover front 108 and cover rear 114 walls are spaced apart and generally parallel. The cover front wall 108 extends between lower 110 and upper 112 edges. The cover rear wall 114 extends between lower 116 and upper 118 edges. The cover front 108 and cover rear 114 walls extend between opposite cover first 120 and cover second 126 end walls. The cover first end wall 120 extends between lower 122 and upper 124 edges. The cover second end wall 126 extends between lower 128 and upper 130 edges. The cover 106 has a transverse cover plane with upper and lower surfaces, and a longitudinal central axis lying within the cover plane (not shown). The cover 106 has a top wall 132 with a concave inner surface 134 facing downward and extending along the central axis between the cover first 120 and cover second 126 end walls. The top wall 132 extends in a circular arc around the central axis. The cover 106 has a plurality of upper sector fins 136 spaced apart along the central axis on the top wall inner surface 134. The upper sector fins 136 each extend in a helical arc around the central axis. The top wall 132 and the upper sector fins 136 extend arcuately from the cover plane upper surface adjacent the cover front wall lower edge 110 to the cover plane upper surface adjacent the cover rear wall lower edge 116. The cover 106 has a cover flange 138 extending around the cover front and cover rear wall upper edges 112 and 118, and around the cover first and cover second end wall upper edges 124 and 130. The cover flange 138 projects outward from the cover, and has a downward facing ridge 140 extending around the cover flange 138. The cover 106 has a cover first seal seat 137 on the top wall inner surface 134 adjacent the cover first end wall 120, and a cover second seal seat 139 on the top wall inner surface 134 adjacent the cover second end wall 126. The seal seats 137 and 139 will be described more completely later on.

The cover 106 is molded as a single, unitary piece from a polymeric material selected from the group consisting of thermoplastic resins and thermoset resins. The cover 106 is adapted for assembly into the housing 22 in a direction transverse to the housing central axis.

A tube is provided, the tube 144 being a circular cylinder and having a central axis. The tube 144 has inner 146 and outer 148 surfaces extending along the central axis between opposite first 150 and second 152 ends. The tube 144 is adapted for assembly into the housing 22 in a direction transverse to the housing central axis. The tube 144 is made from a metal selected from the group consisting of copper, brass, bronze, monel, and stainless steel. The preferred material for the tube 144 is copper, due to the high thermal conductivity and nonfouling properties of copper, especially in salt water.

First and second sealing means are provided for sealing the tube first end 150 and second end 152, respectively, to the housing 22. In particular, the first and second sealing means comprise an annular first seal 154 and an annular second seal 162, respectively. The first seal 154 has a longitudinal central axis, an inner face 156 perpendicular to the central axis, an outer face 158 perpendicular to the central axis, and an annular groove 160 on the inner face 156. The annular groove 160 is adapted to receive the tube first end 150. The second seal 162 has a longitudinal central axis, an inner face 164 perpendicular to the central axis, an outer face 166 perpendicular to the central axis, and an annular groove 168 on the inner face 164. The annular groove 168 is adapted to receive the tube second end 152. Accordingly, the tube first end 150 is received in the first seal annular groove 160 and the tube second end 152 is received in the second seal annular groove 168. The tube 144 and the first 154 and second 162 seals are received in the housing 22 with the tube 144 closely adjacent, and preferably in contact with, the lower sector fins 56. The tube central axis is substantially collinear with the housing central axis. This places the first primary coolant nozzle 62 in communication with the tube 144 at the tube first end 150, and the second primary coolant nozzle 72 in communication with the tube 144 at the tube second end 152. The first seal 154 is received in the housing first seal seat 24, and the second seal 162 is received in the housing second seal seat 28. The first 154 and second 162 seals are molded from an elastomeric material.

The cover 106 is received in the housing 22 with the cover plane closely adjacent the housing plane. The cover first 120 and cover second 126 end walls are adjacent the housing first 40 and housing second 42 end walls respectively. The upper sector fins 136 are closely adjacent, and preferably in contact with, the tube 144. The upper sector fins 136 are substantially aligned with the lower sector fins 56, so as to form a helix around the tube 144. When assembled, the cover central axis, the housing central axis, and the tube central axis are substantially collinear with one another. The first seal 154 is received in the cover first seal seat 137, and the second seal 162 is received in the cover second seal seat 139.

Figure 12:
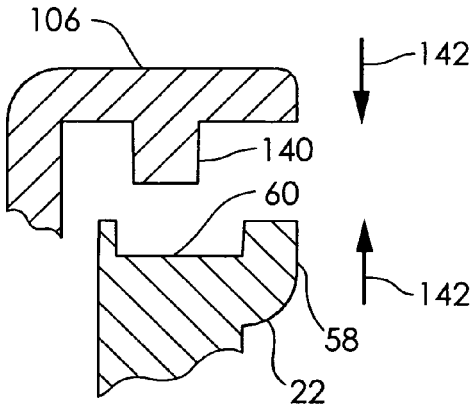
FIG. 12 is an enlarged, detail view the housing flange groove and the cover flange ridge of the heat exchanger of FIG. 1, in the open position, taken at detail 13 of FIG. 2.
Figure 13:
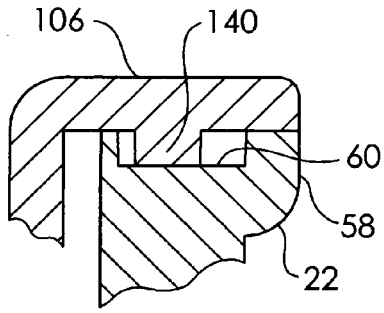
FIG. 13 is an enlarged, detail view the housing flange groove and the cover flange ridge of the heat exchanger of FIG. 1, in the closed position, taken at detail 13 of FIG. 2.
Figure 14:
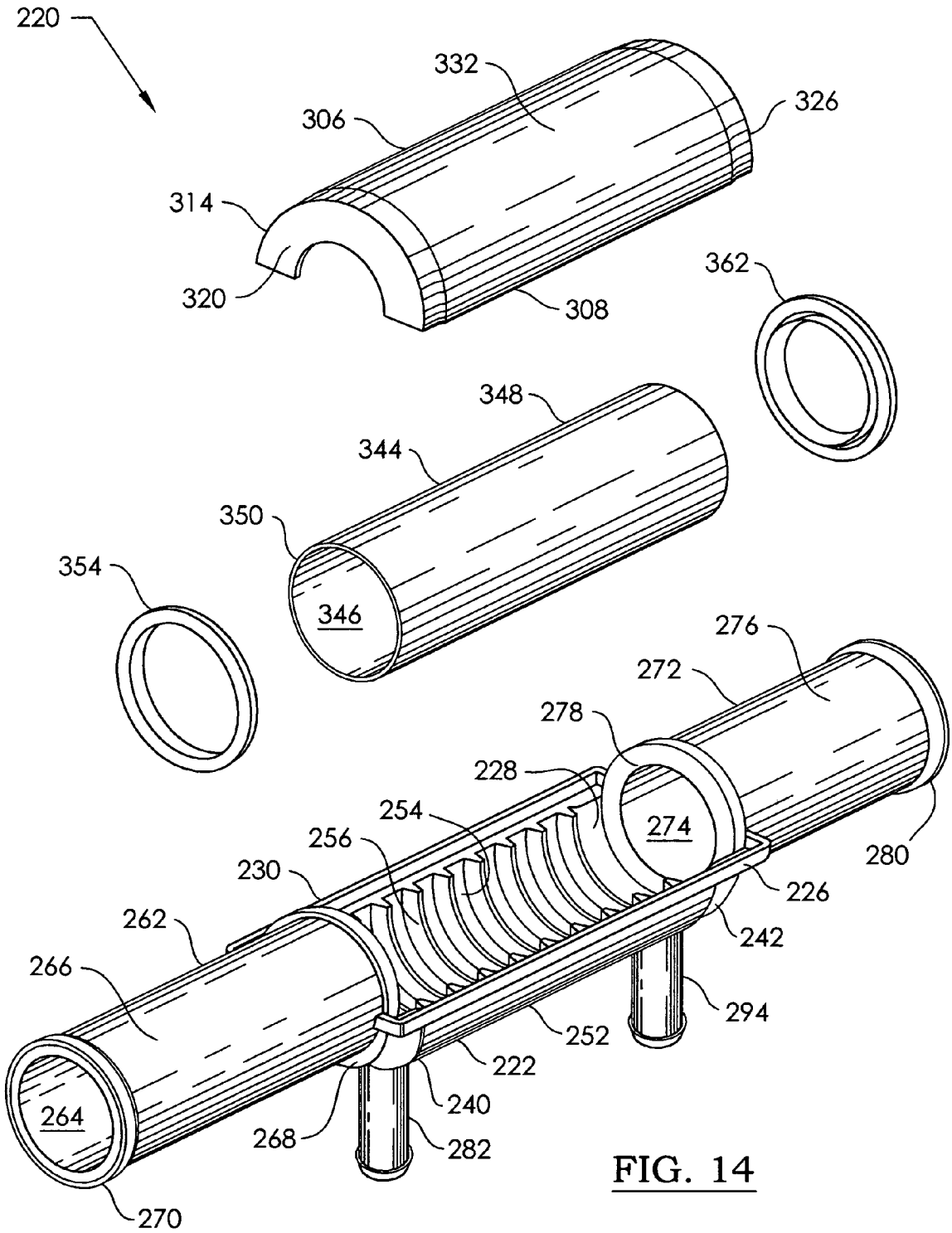
FIG. 14 is an exploded assembly view of another heat exchanger constructed in accordance with the invention.
Figure 16:
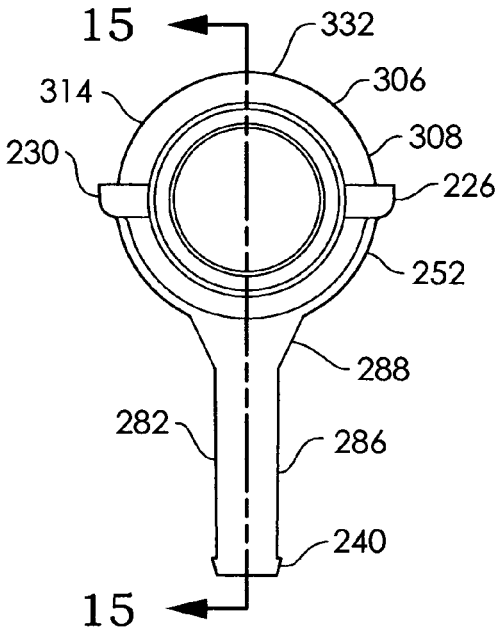
FIG. 16 is a left side elevational view of the heat exchanger of FIG. 14, taken along lines 16-16 of FIG. 15.
Figure 17:
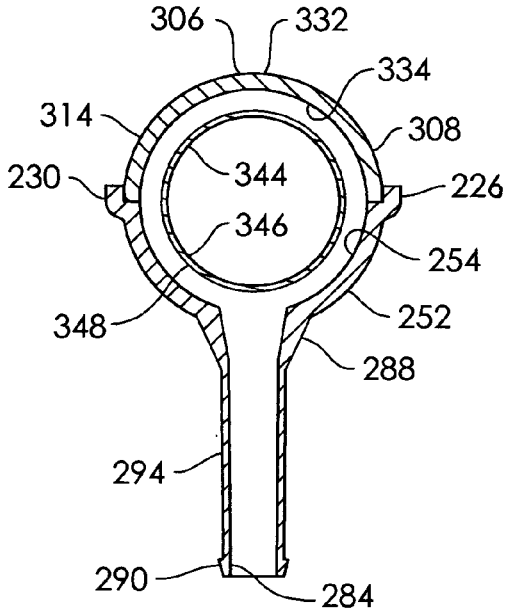
FIG. 17 is a left side sectional elevational view of the heat exchanger of FIG. 14, taken along lines 17-17 of FIG. 15.
Figure 15:
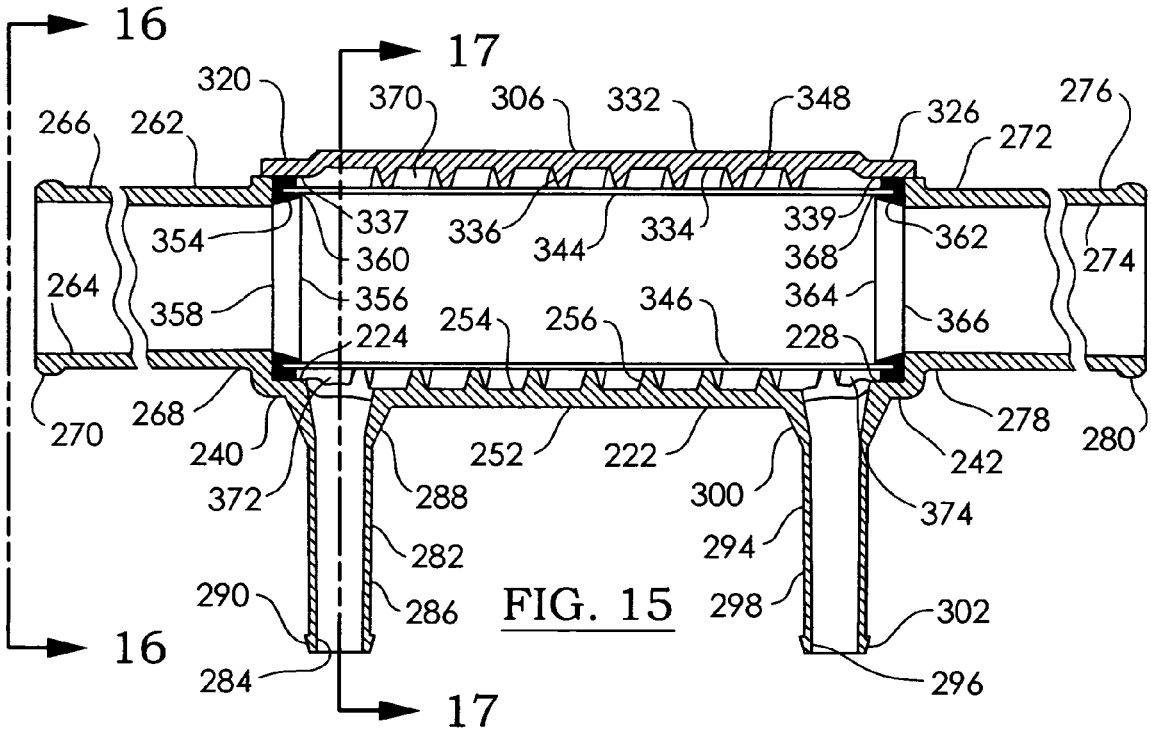
FIG. 15 is a front, sectional elevational view of the heat exchanger of FIG. 14, taken along lines 15-15 of FIG. 16.

The cover flange ridge 140 is adapted for assembly into the housing flange groove 60 by ultrasonic welding, as shown in FIGS. 12 and 13. The cover 106 and the housing 22 are brought together in the direction of arrows 142, and ultrasonic energy is applied to soften and fuse the parts together, especially with thermoplastic resins. In the case of thermoset resins, the parts can be joined with an adhesive such as epoxy or ethyl cyanoacrylate. In this manner, the tube 144, the first 154 and second 162 seals, and the cover 106, will be quickly and easily assembled into the housing 22.

The upper sector fins 136, the top wall 132, the lower sector fins 56, the bottom wall 52, and the tube outer surface 148, cooperate to define a helical passageway 170 around the tube outer surface 148. The helical passageway 170, or turbulator, extends in a spiral or helical path from a helical passageway first end 172 adjacent the housing first end wall 40 to a helical passageway second end 174 adjacent the housing second end wall 42. The first secondary coolant conduit 92 is in communication with the first secondary coolant nozzle 82 and the helical passageway first end 172.

The second secondary coolant conduit 104 is in communication with the second secondary coolant nozzle 100 and the helical passageway second end 174.

Thus, the first and second primary coolant nozzles 62 and 72 respectively, will direct the primary fluid coolant through the tube 144. The first and second secondary coolant nozzles 82 and 94 respectively, will direct the secondary fluid coolant through the helical passageway 170. This will allow heat to be conducted through the tube 144 between the primary and secondary fluid coolants.

The first seal 154 will prevent leakage of either primary or secondary coolants around the outside of the first seal 154 and past the cover first seal seat 137 and the housing first seal seat 24. The first seal 154 will also prevent leakage around the inside of the first seal annular groove 160 and past the tube first end 150.

Similarly, the second seal 162 will prevent leakage of either primary or secondary coolants around the outside of the second seal 162 and past the cover second seal seat 139 and the housing second seal seat 28. The second seal 162 will also prevent leakage around the inside of the second seal annular groove 168 and past the tube second end 152.

Mounting means is provided for mounting the heat exchanger 20 on a support structure (not shown). The mounting means includes a mounting bracket 176 attached to the housing flange 58 and housing rear wall 30. The bracket 176 has a hole 178 through it for a fastener.

Referring now to FIGS. 14 through 17, as well as 9, 10, and 11, another embodiment of the heat exchanger is shown at 220. Heat exchanger 220 is similar to heat exchanger 20 described above, in that it is for transferring heat between a primary fluid coolant and a secondary fluid coolant, supplied by a primary fluid coolant system and a secondary fluid coolant system respectively (not shown). The heat exchanger 220 comprises a housing 222, extending between opposite housing first 240 and housing second 242 ends. The housing 222 has a housing front aspect 226 and a housing rear aspect 230. The housing 222 has a transverse housing plane (not shown) with upper and lower surfaces. The housing 222 has a longitudinal central axis (not shown) lying within the housing plane. The housing 222 has a bottom wall 252 with a concave inner surface 254 facing upward and extending along the central axis between the housing first 240 and housing second 242 ends. The bottom wall 252 extends in a circular arc around the central axis. The housing 222 has a plurality of lower sector fins 256 spaced apart along the central axis on the bottom wall inner surface 254. The lower sector fins 256 each extend in a helical arc around the central axis. The bottom wall 252 and the lower sector fins 256 extend arcuately from the housing plane lower surface adjacent the housing front aspect 226 to the housing plane lower surface adjacent the housing rear aspect 230. The housing 222 has a housing first seal seat 224 on the bottom wall inner surface 254 adjacent the housing first end 240, and a housing second seal seat 228 on the bottom wall inner surface 254 adjacent the housing second end 242.

A first primary connecting means is provided, which includes a first primary coolant nozzle 262. Specifically, the first primary coolant nozzle 262 is a circular cylinder having a central axis, with inner 264 and outer 266 surfaces extending along the central axis between opposite proximal 268 and distal 270 ends. The proximal end 268 is attached to the housing first end 240. The first primary coolant nozzle central axis is substantially collinear with the housing central axis.

A second primary connecting means is provided, which includes a second primary coolant nozzle 272. Specifically, the second primary coolant nozzle 272 is a circular cylinder having a central axis, with inner 274 and outer 276 surfaces extending along the central axis between opposite proximal 278 and distal 280 ends. The proximal end 278 is attached to the housing second end 242. The second primary coolant nozzle central axis is substantially collinear with the housing central axis.

A first secondary connecting means is provided, which includes a first secondary coolant nozzle 282. Specifically, the first secondary coolant nozzle 282 is a circular cylinder and having a central axis, with inner 284 and outer 286 surfaces extending along the central axis between opposite proximal 288 and distal 290 ends. The first secondary coolant nozzle proximal end 288 is attached to the housing 222 adjacent the housing first end 240.

A second secondary connecting means is provided, which includes a second secondary coolant nozzle 294. Specifically, the second secondary coolant nozzle 294 is a circular cylinder having a central axis, with inner 296 and outer 298 surfaces extending along the central axis between opposite proximal 300 and distal 302 ends. The second secondary coolant nozzle proximal end 300 is attached to the housing 222 adjacent the housing second end 242.

The heat exchanger 220 further comprises a cover 306 having a cover front aspect 308, and an opposite cover rear aspect 314. The cover front 308 and cover rear 314 aspects extend between opposite cover first 320 and cover second 326 ends. The cover 306 has a transverse cover plane with upper and lower surfaces, and a longitudinal central axis lying within the cover plane (not shown). The cover 306 has a top wall 332 with a concave inner surface 334 facing downward and extending along the central axis between the cover first 320 and cover second 326 ends. The top wall 332 extends in a circular arc around the central axis. The cover 306 has a plurality of upper sector fins 336 spaced apart along the central axis on the top wall inner surface 334. The upper sector fins 336 each extend in a helical arc around the central axis. The top wall 332 and the upper sector fins 336 extend arcuately from the cover plane upper surface adjacent the cover front aspect 308 to the cover plane upper surface adjacent the cover rear aspect 314. The cover 306 has a cover first seal seat 337 on the top wall inner surface 334 adjacent the cover first end 320, and a cover second seal seat 339 on the top wall inner surface 334 adjacent the cover second end 326.

A tube is provided, the tube 344 being a circular cylinder and having a central axis. The tube 344 has inner 346 and outer 348 surfaces extending along the central axis between opposite first 350 and second 352 ends. The tube 344 is adapted for assembly into the housing 222 in a direction transverse to the housing central axis.

First and second sealing means are provided for sealing the tube first end 350 and second end 352, respectively, to the housing 222. In particular, the first and second sealing means comprise an annular first seal 354 and an annular second seal 362, respectively. The first seal 354 has a longitudinal central axis, an inner face 356 perpendicular to the central axis, an outer face 358 perpendicular to the central axis, and an annular groove 360 on the inner face 356. The annular groove 360 is adapted to receive the tube first end 350. The second seal 362 has a longitudinal central axis, an inner face 364 perpendicular to the central axis, an outer face 366 perpendicular to the central axis, and an annular groove 368 on the inner face 364. The annular groove 368 is adapted to receive the tube second end 352. Accordingly, the tube first end 350 is received in the first seal annular groove 360 and the tube second end 352 is received in the second seal annular groove 368. The tube 344 and the first 354 and second 362 seals are received in the housing 222 with the tube 344 closely adjacent, and preferably in contact with, the lower sector fins 256. The tube central axis is substantially collinear with the housing central axis. This places the first primary coolant nozzle 262 in communication with the tube 344 at the tube first end 350, and the second primary coolant nozzle 272 in communication with the tube 344 at the tube second end 352. The first seal 354 is received in the housing first seal seat 224, and the second seal 362 is received in the housing second seal seat 228.

The cover 306 is received in the housing 222 with the cover plane closely adjacent the housing plane. The cover first 320 and cover second 326 ends are adjacent the housing first 240 and housing second 242 ends respectively. The upper sector fins 336 are closely adjacent, and preferably in contact with, the tube 344. The upper sector fins 336 are substantially aligned with the lower sector fins 256, so as to form a helix around the tube 344. When assembled, the cover central axis, the housing central axis, and the tube central axis are substantially collinear with one another. The first seal 354 is received in the cover first seal seat 337, and the second seal 362 is received in the cover second seal seat 339.

The upper sector fins 336, the top wall 332, the lower sector fins 256, the bottom wall 252, and the tube outer surface 348, cooperate to define a helical passageway 370 around the tube outer surface 348. The helical passageway 370 extends in a spiral or helical path from a helical passageway first end 372 adjacent the housing first end 240 to a helical passageway second end 374 adjacent the housing second end 242. The first secondary coolant nozzle 282 is in communication with the helical passageway first end 372. The second secondary coolant nozzle 300 is in communication with the helical passageway second end 374.

Thus, the first and second primary coolant nozzles 262 and 272 respectively, will direct the primary fluid coolant through the tube 344. The first and second secondary coolant nozzles 282 and 294 respectively, will direct the secondary fluid coolant through the helical passageway 370. This will allow heat to be conducted through the tube 344 between the primary and secondary fluid coolants.

Heat exchanger 220 differs from heat exchanger 20 described above, in that it has no housing flange 58 or cover flange 138. The housing 22 and the cover 106 are attached directly together with adhesive. There is no first secondary coolant conduit 92, and no second secondary coolant conduit 104. The first secondary coolant nozzle 282, and the second secondary coolant nozzle 294, are attached directly to the housing 222. Heat exchanger 220 has no integral mounting bracket 176.

Numerous modifications and alternative embodiments of the invention will be apparent to those skilled in the art in view of the foregoing description. Accordingly, this description is to be construed as illustrative only and is for the purpose of teaching those, skilled in the art the best mode of carrying out the invention. Details of the structure may be varied substantially without departing from the spirit of the invention and the exclusive use of all modifications that will come within the scope of the appended claims is reserved.

PARTS LIST
PLASTIC OIL COOLER

| PART NO. | DESCRIPTION |
|---|---|
| 20 | heat exchanger |
| 22 | housing |
| 24 | first seal seat |
| 26 | housing front wall |
| 28 | second seal seat |
| 30 | housing rear wall |
| 32 | housing front wall lower edge |
| 34 | housing front wall upper edge |
| 36 | housing rear wall lower edge |
| 38 | housing rear wall upper edge |
| 40 | housing first end wall |
| 42 | housing second end wall |
| 44 | housing first end wall lower edge |
| 46 | housing first end wall upper edge |
| 48 | housing second end wall lower edge |
| 50 | housing second end wall upper edge |
| 52 | housing bottom wall |
| 54 | bottom wall concave inner surface |
| 56 | lower sector fins |
| 58 | housing flange |
| 60 | upward facing groove |
| 62 | first primary coolant nozzle |
| 64 | first primary coolant nozzle inner surface |
| 66 | first primary coolant nozzle outer surface |
| 68 | first primary coolant nozzle proximal end |
| 70 | first primary coolant nozzle distal end |
| 72 | second primary coolant nozzle |
| 74 | second primary coolant nozzle inner surface |
| 76 | second primary coolant nozzle outer surface |
| 78 | second primary coolant nozzle proximal end |
| 80 | second primary coolant nozzle distal end |
| 82 | first secondary coolant nozzle |
| 84 | first secondary coolant nozzle inner surface |
| 86 | first secondary coolant nozzle outer surface |
| 88 | first secondary coolant nozzle proximal end |
| 90 | first secondary coolant nozzle distal end |
| 92 | first secondary coolant conduit |
| 94 | second secondary coolant nozzle |
| 96 | second secondary coolant nozzle inner surface |
| 98 | second secondary coolant nozzle outer surface |
| 100 | second secondary coolant nozzle proximal end |
| 102 | second secondary coolant nozzle distal end |
| 104 | second secondary coolant conduit |
| 106 | cover |
| 108 | cover front wall |
| 110 | cover front wall lower edge |
| 112 | cover front wall upper edge |
| 114 | cover rear wall |
| 116 | cover rear wall lower edge |
| 118 | cover rear wall upper edge |
| 120 | cover first end wall |
| 122 | cover first end wall lower edge |
| 124 | cover first end wall upper edge |
| 126 | cover second end wall |
| 128 | cover second end wall lower edge |
| 130 | cover second end wall upper edge |
| 132 | cover top wall |
| 134 | top wall concave inner surface |
| 136 | upper sector fins |

-continued

PARTS LIST
PLASTIC OIL COOLER

| PART NO. | DESCRIPTION |
|---|---|
| 137 | cover first seal seat |
| 138 | cover flange |
| 139 | cover second seal seat |
| 140 | downward facing ridge |
| 142 | arrows |
| 144 | tube |
| 146 | tube inner surface |
| 148 | tube outer surface |
| 150 | tube first end |
| 152 | tube second end |
| 154 | first annular seal |
| 156 | first seal inner face |
| 158 | first seal outer face |
| 160 | first seal annular groove |
| 162 | second annular seal |
| 164 | second seal inner face |
| 166 | second seal outer face |
| 168 | second seal annular groove |
| 170 | helical passageway |
| 172 | helical passageway first end |
| 174 | helical passageway second end |
| 176 | mounting bracket |
| 178 | hole |
| 220 | heat exchanger |
| 222 | housing |
| 224 | first seal seat |
| 226 | housing front aspect |
| 228 | second seal seat |
| 230 | housing rear aspect |
| 240 | housing first end |
| 242 | housing second end |
| 252 | housing bottom wall |
| 254 | bottom wall concave inner surface |
| 256 | lower sector fins |
| 262 | first primary coolant nozzle |
| 264 | first primary coolant nozzle inner surface |
| 266 | first primary coolant nozzle outer surface |
| 268 | first primary coolant nozzle proximal end |
| 270 | first primary coolant nozzle distal end |
| 272 | second primary coolant nozzle |
| 274 | second primary coolant nozzle inner surface |
| 276 | second primary coolant nozzle outer surface |
| 278 | second primary coolant nozzle proximal end |
| 280 | second primary coolant nozzle distal end |
| 282 | first secondary coolant nozzle |
| 284 | first secondary coolant nozzle inner surface |
| 286 | first secondary coolant nozzle outer surface |
| 288 | first secondary coolant nozzle proximal end |
| 290 | first secondary coolant nozzle distal end |
| 294 | second secondary coolant nozzle |
| 296 | second secondary coolant nozzle inner surface |
| 298 | second secondary coolant nozzle outer surface |
| 300 | second secondary coolant nozzle proximal end |
| 302 | second secondary coolant nozzle distal end |
| 306 | cover |
| 308 | cover front aspect |
| 314 | cover rear aspect |
| 320 | cover first end |
| 326 | cover second end |

-continued

PARTS LIST
PLASTIC OIL COOLER

| PART NO. | DESCRIPTION |
|---|---|
| 332 | cover top wall |
| 334 | top wall concave inner surface |
| 336 | upper sector fins |
| 337 | cover first seal seat |
| 339 | cover second seal seat |
| 344 | tube |
| 346 | tube inner surface |
| 348 | tube outer surface |
| 350 | tube first end |
| 352 | tube second end |
| 354 | first annular seal |
| 356 | first seal inner face |
| 358 | first seal outer face |
| 360 | first seal annular groove |
| 362 | second annular seal |
| 364 | second seal inner face |
| 366 | second seal outer face |
| 368 | second seal annular groove |
| 370 | helical passageway |
| 372 | helical passageway first end |
| 374 | helical passageway second end |

The invention claimed is:

1. A heat exchanger for transferring heat between a primary fluid coolant and a secondary fluid coolant, supplied by a primary fluid coolant system and a secondary fluid coolant system respectively, the heat exchanger comprising:

a housing, the housing having opposite housing front and housing rear aspects extending between opposite housing first and housing second ends, the housing having a transverse housing plane with upper and lower surfaces, the housing having a longitudinal central axis lying within the housing plane, the housing having a bottom wall with a concave inner surface facing upward and extending along the central axis between the housing first and housing second ends, the bottom wall extending in a circular arc around the central axis, the housing having a plurality of lower sector fins spaced apart along the central axis on the bottom wall inner surface, the lower sector fins each extending in a helical arc around the central axis, the bottom wall and the lower sector fins extending arcuately from the housing plane lower surface adjacent the housing front aspect to the housing plane lower surface adjacent the housing rear aspect;

a cover, the cover having opposite cover front and cover rear aspects extending between opposite cover first and cover second ends, the cover having a transverse cover plane with upper and lower surfaces, the cover having a longitudinal central axis lying within the cover plane, the cover having a top wall with a concave inner surface facing downward and extending along the central axis between the cover first and cover second ends, the top wall extending in a circular arc around the central axis, the cover having a plurality of upper sector fins spaced apart along the central axis on the top wall inner surface, the upper sector fins each extending in a helical arc around the central axis, the top wall and the upper sector fins extending arcuately from the cover plane upper surface adjacent the cover front aspect to the cover plane upper surface adjacent the cover rear aspect, the cover being adapted for assembly into the housing in a direction transverse to the housing central axis;

a tube, the tube being a circular cylinder and having a central axis, the tube having inner and outer surfaces extending along the central axis between opposite first and second ends, the tube being adapted for assembly into the housing in a direction transverse to the housing central axis;

first sealing means for sealing the tube first end to the housing;

second sealing means for sealing the tube second end to the housing;

the tube and the first and second sealing means being received in the housing with the tube closely adjacent the lower sector fins, and with the tube central axis being substantially collinear with the housing central axis;

the cover being received in the housing with the cover plane closely adjacent the housing plane, the cover first and cover second ends adjacent the housing first and housing second ends respectively, the upper sector fins closely adjacent the tube, the upper sector fins being substantially aligned with the lower sector fins, and the cover central axis being substantially collinear with the housing central axis;

the upper sector fins, the top wall, the lower sector fins, the bottom wall, and the tube outer surface defining a helical passageway around the tube outer surface from a helical passageway first end adjacent the housing first end to a helical passageway second end adjacent the housing second end;

first primary connecting means for connecting the primary fluid coolant system to the tube first end;

second primary connecting means for connecting the primary fluid coolant system to the tube second end, so as to allow a flow of primary fluid coolant between the primary fluid coolant system and the tube;

first secondary connecting means for connecting the secondary fluid coolant system to the helical passageway first end; and second secondary connecting means for connecting the secondary fluid coolant system to the helical passageway second end, so as to allow a flow of secondary fluid coolant between the secondary fluid coolant system and the helical passageway;

whereby the tube, the first and second sealing means, and the cover, will be quickly and easily assembled into the housing.

2. The heat exchanger of claim 1, wherein:

the first sealing means includes an annular first seal, the first seal having a longitudinal central axis, an inner face substantially perpendicular to the central axis, an outer face substantially perpendicular to the central axis, and an annular groove on the inner face, the tube first end being received in the first seal annular groove; and the second sealing means includes an annular second seal, the second seal having a longitudinal central axis, an inner face substantially perpendicular to the central axis, an outer face substantially perpendicular to the central axis, and an annular groove on the inner face, the tube second end being received in the second seal annular groove;

the first and second seals being molded from an elastomeric material.

3. The heat exchanger of claim 2, further comprising:

a housing first seal seat on the bottom wall inner surface adjacent the housing first end;

a cover first seal seat on the top wall inner surface adjacent the cover first end, the first seal being received in the housing first seal seat and the cover first seal seat, so as to prevent leakage of primary fluid coolant and secondary fluid coolant past the first seal;

a housing second seal seat on the bottom wall inner surface adjacent the housing second end; and a cover second seal seat on the top wall inner surface adjacent the cover second end, the second seal being received in the housing second seal seat and the cover second seal seat, so as to prevent leakage of primary fluid coolant and secondary fluid coolant past the second seal.

4. The heat exchanger of claim 1, wherein:

the first primary connecting means includes a first primary coolant nozzle, the first primary coolant nozzle being a circular cylinder and having a central axis, the first primary coolant nozzle having inner and outer surfaces extending along the central axis between opposite proximal and distal ends, the proximal end being attached to the housing first end, the first primary coolant nozzle central axis being substantially collinear with the housing central axis, the first primary coolant nozzle being in communication with the tube; and the second primary connecting means includes a second primary coolant nozzle, the second primary coolant nozzle being a circular cylinder and having a central axis, the second primary coolant nozzle having inner and outer surfaces extending along the central axis between opposite proximal and distal ends, the proximal end being attached to the housing second end, the second primary coolant nozzle central axis being substantially collinear with the housing central axis, the second primary coolant nozzle being in communication with the tube;

whereby the first and second primary coolant nozzles will direct the primary fluid coolant through the tube.

5. The heat exchanger of claim 4, wherein:

the first secondary connecting means includes:

a first secondary coolant nozzle, the first secondary coolant nozzle being a circular cylinder and having a central axis, the first secondary coolant nozzle having inner and outer surfaces extending along the central axis between opposite proximal and distal ends, the proximal end being attached to the housing adjacent the housing first end, the first secondary coolant nozzle being in communication with the helical passageway first end; and the second secondary connecting means includes:

a second secondary coolant nozzle, the second secondary coolant nozzle being a circular cylinder and having a central axis, the second secondary coolant nozzle having inner and outer surfaces extending along the central axis between opposite proximal and distal ends, the proximal end being attached to the housing adjacent the housing second end, the second secondary coolant nozzle being in communication with the helical passageway second end;

whereby the first and second secondary coolant nozzles will direct the secondary fluid coolant through the helical passageway, so as to allow heat to be conducted through the tube between the primary and secondary fluid coolants.

6. The heat exchanger of claim 5, wherein the housing, the first primary coolant nozzle, the second primary coolant nozzle, the first secondary coolant nozzle, and the second secondary coolant nozzle, are constructed as a single, unitary piece.

7. The heat exchanger of claim 6, wherein the housing, the first primary coolant nozzle, the second primary coolant nozzle, the first secondary coolant nozzle, and the second secondary coolant nozzle, are molded from a polymeric material selected from the group consisting of thermoplastic resins and thermoset resins.

8. The heat exchanger of claim 1, wherein the cover is constructed as a single, unitary piece.

9. The heat exchanger of claim 8, wherein the cover is molded from a polymeric material selected from the group consisting of thermoplastic resins and thermoset resins.

10. The heat exchanger of claim 1, wherein the tube is made from a metal selected from the group consisting of copper, brass, bronze, monel, and stainless steel.

11. A heat exchanger for transferring heat between a primary fluid coolant and a secondary fluid coolant, supplied by a primary fluid coolant system and a secondary fluid coolant system respectively, the heat exchanger comprising:

a housing, the housing having opposite housing front and housing rear walls spaced apart and generally parallel, the housing front and housing rear walls extending between lower and upper edges, the housing front and housing rear walls extending between opposite housing first and housing second end walls, the housing first and housing second end walls extending between lower and upper edges, the housing having a transverse housing plane with upper and lower surfaces, the housing having a longitudinal central axis lying within the housing plane, the housing having a bottom wall with a concave inner surface facing upward and extending along the central axis between the housing first and housing second end walls, the bottom wall extending in a circular arc around the central axis, the housing having a plurality of lower sector fins spaced apart along the central axis on the bottom wall inner surface, the lower sector fins each extending in a helical arc around the central axis, the bottom wall and the lower sector fins extending arcuately from the housing plane lower surface adjacent the housing front wall lower edge to the housing plane lower surface adjacent the housing rear wall lower edge, the housing having a housing flange extending around the housing front and housing rear wall upper edges and around the housing first and housing second end wall upper edges, the housing flange projecting outward from the housing, the housing flange having an upward facing groove extending around the housing flange;

a cover, the cover having opposite cover front and cover rear walls spaced apart and generally parallel, the cover front and cover rear walls extending between lower and upper edges, the cover front and cover rear walls extending between opposite cover first and cover second end walls, the cover first and cover second end walls extending between lower and upper edges, the cover having a transverse cover plane with upper and lower surfaces, the cover having a longitudinal central axis lying within the cover plane, the cover having a top wall with a concave inner surface facing downward and extending along the central axis between the cover first and cover second end walls, the top wall extending in a circular arc around the central axis, the cover having a plurality of upper sector fins spaced apart along the central axis on the top wall inner surface, the upper sector fins each extending in a helical arc around the central axis, the top wall and the upper sector fins extending arcuately from the cover plane upper surface adjacent the cover front wall lower edge to the cover plane upper surface adjacent the cover rear wall lower edge, the cover having a cover flange extending around the cover front and cover rear wall upper edges and around the cover first and cover second end wall upper edges, the cover flange projecting outward from the cover, the cover flange having a downward facing ridge extending around the cover flange, the cover being adapted for assembly into the housing in a direction transverse to the housing central axis, the cover flange ridge being adapted for assembly into the housing flange groove by ultrasonic welding;

a tube, the tube being a circular cylinder and having a central axis, the tube having inner and outer surfaces extending along the central axis between opposite first and second ends, the tube being adapted for assembly into the housing in a direction transverse to the housing central axis;

first sealing means for sealing the tube first end to the housing;

second sealing means for sealing the tube second end to the housing;

the tube and the first and second sealing means being received in the housing with the tube closely adjacent the lower sector fins, and with the tube central axis being substantially collinear with the housing central axis;

the cover being received in the housing with the cover plane closely adjacent the housing plane, the cover first and cover second end walls adjacent the housing first and housing second end walls respectively, the upper sector fins closely adjacent the tube, the upper sector fins being substantially aligned with the lower sector fins, the cover central axis being substantially collinear with the housing central axis, and the cover flange ridge being attached to the housing flange groove;

the upper sector fins, the top wall, the lower sector fins, the bottom wall, and the tube outer surface defining a helical passageway around the tube outer surface from a helical passageway first end adjacent the housing first end wall to a helical passageway second end adjacent the housing second end wall;

first primary connecting means for connecting the primary fluid coolant system to the tube first end;

second primary connecting means for connecting the primary fluid coolant system to the tube second end, so as to allow a flow of primary fluid coolant between the primary fluid coolant system and the tube;

first secondary connecting means for connecting the secondary fluid coolant system to the helical passageway first end; and second secondary connecting means for connecting the secondary fluid coolant system to the helical passageway second end, so as to allow a flow of secondary fluid coolant between the secondary fluid coolant system and the helical passageway;

whereby the tube, the first and second sealing means, and the cover, will be quickly and easily assembled into the housing.

12. The heat exchanger of claim 11, wherein:

the first sealing means includes an annular first seal, the first seal having a longitudinal central axis, an inner face substantially perpendicular to the central axis, an outer face substantially perpendicular to the central axis, and an annular groove on the inner face, the tube first end being received in the first seal annular groove; and the second sealing means includes an annular second seal, the second seal having a longitudinal central axis, an inner face substantially perpendicular to the central axis, an outer face substantially perpendicular to the central axis, and an annular groove on the inner face, the tube second end being received in the second seal annular groove;

the first and second seals being molded from an elastomeric material.

13. The heat exchanger of claim 12, further comprising:

a housing first seal seat on the bottom wall inner surface adjacent the housing first end wall;

a cover first seal seat on the top wall inner surface adjacent the cover first end wall, the first seal being received in the housing first seal seat and the cover first seal seat, so as to prevent leakage of primary fluid coolant and secondary fluid coolant past the first seal;

a housing second seal seat on the bottom wall inner surface adjacent the housing second end wall; and a cover second seal seat on the top wall inner surface adjacent the cover second end wall, the second seal being received in the housing second seal seat and the cover second seal seat, so as to prevent leakage of primary fluid coolant and secondary fluid coolant past the second seal.

14. The heat exchanger of claim 11, wherein:

the first primary connecting means includes a first primary coolant nozzle, the first primary coolant nozzle being a circular cylinder and having a central axis, the first primary coolant nozzle having inner and outer surfaces extending along the central axis between opposite proximal and distal ends, the proximal end being attached to the housing first end wall, the first primary coolant nozzle central axis being substantially collinear with the housing central axis, the first primary coolant nozzle being in communication with the tube; and the second primary connecting means includes a second primary coolant nozzle, the second primary coolant nozzle being a circular cylinder and having a central axis, the second primary coolant nozzle having inner and outer surfaces extending along the central axis between opposite proximal and distal ends, the proximal end being attached to the housing second end wall, the second primary coolant nozzle central axis being substantially collinear with the housing central axis, the second primary coolant nozzle being in communication with the tube;

whereby the first and second primary coolant nozzles will direct the primary fluid coolant through the tube.

15. The heat exchanger of claim 14, wherein:

the first secondary connecting means includes:

a first secondary coolant nozzle, the first secondary coolant nozzle being a circular cylinder and having a central axis, the first secondary coolant nozzle having inner and outer surfaces extending along the central axis between opposite proximal and distal ends; and a first secondary coolant conduit, the first secondary coolant conduit being hollow and extending between the first secondary coolant nozzle proximal end and the housing adjacent the housing first end wall, the first secondary coolant conduit being in communication with the first secondary coolant nozzle and the helical passageway first end; and the second secondary connecting means includes:

a second secondary coolant nozzle, the second secondary coolant nozzle being a circular cylinder and having a central axis, the second secondary coolant nozzle having inner and outer surfaces extending along the central axis between opposite proximal and distal ends; and a second secondary coolant conduit, the second secondary coolant conduit being hollow and extending between the second secondary coolant nozzle proximal end and the housing adjacent the housing second end wall, the second secondary coolant conduit being in communication with the second secondary coolant nozzle and the helical passageway second end;

whereby the first and second secondary coolant nozzles will direct the secondary fluid coolant through the helical passageway, so as to allow heat to be conducted through the tube between the primary and secondary fluid coolants.

16. The heat exchanger of claim 15, wherein the housing, the first primary coolant nozzle, the second primary coolant nozzle, the first secondary coolant nozzle, the second secondary coolant nozzle, the first secondary coolant conduit, and the second secondary coolant conduit, are constructed as a single, unitary piece.

17. The heat exchanger of claim 16, wherein the housing, the first primary coolant nozzle, the second primary coolant nozzle, the first secondary coolant nozzle, the second secondary coolant nozzle, the first secondary coolant conduit, and the second secondary coolant conduit, are molded from a polymeric material selected from the group consisting of thermoplastic resins and thermoset resins.

18. The heat exchanger of claim 11, wherein the cover is constructed as a single, unitary piece.

19. The heat exchanger of claim 18, wherein the cover is molded from a polymeric material selected from the group consisting of thermoplastic resins and thermoset resins.

20. The heat exchanger of claim 11, wherein the tube is made from a metal selected from the group consisting of copper, brass, bronze, monel, and stainless steel.

21. A heat exchanger for transferring heat between a primary fluid coolant and a secondary fluid coolant, supplied by a primary fluid coolant system and a secondary fluid coolant system respectively, the heat exchanger comprising:

a housing, the housing having opposite housing front and housing rear walls spaced apart and generally parallel, the housing front and housing rear walls extending between lower and upper edges, the housing front and housing rear walls extending between opposite housing first and housing second end walls, the housing first and housing second end walls extending between lower and upper edges, the housing having a transverse housing plane with upper and lower surfaces, the housing having a longitudinal central axis lying within the housing plane, the housing having a bottom wall with a concave inner surface facing upward and extending along the central axis between the housing first and housing second end walls, the bottom wall extending in a circular arc around the central axis, the housing having a plurality of lower sector fins spaced apart along the central axis on the bottom wall inner surface, the lower sector fins each extending in a helical arc around the central axis, the bottom wall and the lower sector fins extending arcuately from the housing plane lower surface adjacent the housing front wall lower edge to the housing plane lower surface adjacent the housing rear wall lower edge, the housing having a housing flange extending around the housing front and housing rear wall upper edges and around the housing first and housing second end wall upper edges, the housing flange projecting outward from the housing, the housing flange having an upward facing groove extending around the housing flange;

a first primary coolant nozzle, the first primary coolant nozzle being a circular cylinder and having a central axis, the first primary coolant nozzle having inner and outer surfaces extending along the central axis between opposite proximal and distal ends, the proximal end being attached to the housing first end wall, the first primary coolant nozzle central axis being substantially collinear with the housing central axis;

a second primary coolant nozzle, the second primary coolant nozzle being a circular cylinder and having a central axis, the second primary coolant nozzle having inner and outer surfaces extending along the central axis between opposite proximal and distal ends, the proximal end being attached to the housing second end wall, the second primary coolant nozzle central axis being substantially collinear with the housing central axis;

a first secondary coolant nozzle, the first secondary coolant nozzle being a circular cylinder and having a central axis, the first secondary coolant nozzle having inner and outer surfaces extending along the central axis between opposite proximal and distal ends;

a second secondary coolant nozzle, the second secondary coolant nozzle being a circular cylinder and having a central axis, the second secondary coolant nozzle having inner and outer surfaces extending along the central axis between opposite proximal and distal ends;

a first secondary coolant conduit, the first secondary coolant conduit being hollow and extending between the first secondary coolant nozzle proximal end and the housing adjacent the housing first end wall, the first secondary coolant conduit being in communication with the first secondary coolant nozzle and the helical passageway first end;

a second secondary coolant conduit, the second secondary coolant conduit being hollow and extending between the second secondary coolant nozzle proximal end and the housing adjacent the housing second end wall, the second secondary coolant conduit being in communication with the second secondary coolant nozzle and the helical passageway second end;

the housing, the first primary coolant nozzle, the second primary coolant nozzle, the first secondary coolant nozzle, the second secondary coolant nozzle, the first secondary coolant conduit, and the second secondary coolant conduit, being molded as a single, unitary piece from a polymeric material selected from the group consisting of thermoplastic resins and thermoset resins;

a cover, the cover having opposite cover front and cover rear walls spaced apart and generally parallel, the cover front and cover rear walls extending between lower and upper edges, the cover front and cover rear walls extending between opposite cover first and cover second end walls, the cover first and cover second end walls extending between lower and upper edges, the cover having a transverse cover plane with upper and lower surfaces, the cover having a longitudinal central axis lying within the cover plane, the cover having a top wall with a concave inner surface facing downward and extending along the central axis between the cover first and cover second end walls, the top wall extending in a circular arc around the central axis, the cover having a plurality of upper sector fins spaced apart along the central axis on the top wall inner surface, the upper sector fins each extending in a helical arc around the central axis, the top wall and the upper sector fins extending arcuately from the cover plane upper surface adjacent the cover front wall lower edge to the cover plane upper surface adjacent the cover rear wall lower edge, the cover having a cover flange extending around the cover front and cover rear wall upper edges and around the cover first and cover second end wall upper edges, the cover flange projecting outward from the cover, the cover flange having a downward facing ridge extending around the cover flange, the cover being adapted for assembly into the housing in a direction transverse to the housing central axis, the cover flange ridge being adapted for assembly into the housing flange groove by ultrasonic welding, the cover being molded as a single, unitary piece from a polymeric material selected from the group consisting of thermoplastic resins and thermoset resins;

a tube, the tube being a circular cylinder and having a central axis, the tube having inner and outer surfaces extending along the central axis between opposite first and second ends, the tube being adapted for assembly into the housing in a direction transverse to the housing central axis, the tube being made from a metal selected from the group consisting of copper, brass, bronze, monel, and stainless steel;

an annular first seal and an annular second seal, each one of the first and second seals having a longitudinal central axis, an inner face substantially perpendicular to the central axis, an outer face substantially perpendicular to the central axis, and an annular groove on the inner face, the annular groove being adapted to receive a one of the tube first and second ends, the first and second seals being molded from an elastomeric material;

the tube first end being received in the first seal annular groove and the tube second end being received in the second seal annular groove;

the tube and the first and second seals being received in the housing with the tube closely adjacent the lower sector fins, and with the tube central axis being substantially collinear with the housing central axis, the first and second primary coolant nozzles being in communication with the tube;

the cover being received in the housing with the cover plane closely adjacent the housing plane, the cover first and cover second end walls adjacent the housing first and housing second end walls respectively, the upper sector fins closely adjacent the tube, the upper sector fins being substantially aligned with the lower sector fins, the cover central axis being substantially collinear with the housing central axis, and the cover flange ridge being attached to the housing flange groove;

the upper sector fins, the top wall, the lower sector fins, the bottom wall, and the tube outer surface defining a helical passageway around the tube outer surface from a helical passageway first end adjacent the housing first end wall to a helical passageway second end adjacent the housing second end wall;

mounting means for mounting the heat exchanger on a support structure;

whereby the tube, the first and second seals, and the cover, will be quickly and easily assembled into the housing; and whereby the first and second primary coolant nozzles will direct the primary fluid coolant through the tube, and the first and second secondary coolant nozzles will direct the secondary fluid coolant through the helical passageway, so as to allow heat to be conducted through the tube between the primary and secondary fluid coolants.

22. The heat exchanger of claim 21, wherein the mounting means includes a mounting bracket attached to the housing flange and housing rear wall, the bracket having a hole therethrough for a fastener.

23. The heat exchanger of claim 21, further comprising:

a housing first seal seat on the bottom wall inner surface adjacent the housing first end wall;

a cover first seal seat on the top wall inner surface adjacent the cover first end wall, the first seal being received in the housing first seal seat and the cover first seal seat, so as to prevent leakage of primary fluid coolant and secondary fluid coolant past the first seal;

a housing second seal seat on the bottom wall inner surface adjacent the housing second end wall; and a cover second seal seat on the top wall inner surface adjacent the cover second end wall, the second seal being received in the housing second seal seat and the cover second seal seat, so as to prevent leakage of primary fluid coolant and secondary fluid coolant past the second seal.

* * * * *